US006666125B2

(12) United States Patent
Gunzenhauser

(10) Patent No.: US 6,666,125 B2
(45) Date of Patent: Dec. 23, 2003

(54) SWING CYLINDER OSCILLATION CONTROL CIRCUIT AND VALVE FOR OSCILLATING BOOMS

(75) Inventor: Bruce E. Gunzenhauser, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 71 days.

(21) Appl. No.: 10/098,076

(22) Filed: Mar. 14, 2002

(65) Prior Publication Data

US 2003/0172802 A1 Sep. 18, 2003

(51) Int. Cl.[7] ..... F01B 1/00
(52) U.S. Cl. ..... 91/172; 91/468; 60/469
(58) Field of Search ..... 60/469, 468; 91/172, 91/468; 137/496, 494

(56) References Cited

U.S. PATENT DOCUMENTS

| | | | |
|---|---|---|---|
| 3,815,766 | A | 6/1974 | Carlson et al. |
| 5,203,678 | A | 4/1993 | Sugiyama et al. |
| 5,398,507 | A | 3/1995 | Akiyama et al. |
| 5,937,645 | A | 8/1999 | Hamamoto |

*Primary Examiner*—Edward K. Look
*Assistant Examiner*—Michael Leslie

(57) ABSTRACT

A swing cylinder oscillation control circuit and valve for oscillating booms connects two hydraulic cylinders with a shuttle valve and two check valves to provide the higher cylinder pressure to a fluid inlet and a lower cylinder pressure to a fluid outlet of a fast-opening and a slow-closing check valve. The fast-opening and slow-closing check valve uses a poppet and spring to set a valve opening pressure and uses internal flow connections to a large diameter piston that works with mechanically adjustable piston and poppet strokes to control the time for valve closing.

3 Claims, 3 Drawing Sheets

SWING CYLINDER OSCILLATION CONTROL CIRCUIT AND VALVE FOR OSCILLATING BOOMS

BACKGROUND OF THE INVENTION

A typical hydraulic system for a backhoe loader swing function is shown in FIG. 1. The manually operated direction control valve with pressure and tank connections is used to provide flow into one of two cylinders which function to oscillate a boom, and out of the opposite cylinder. A hydraulic hose or tube connects the piston rods of the cylinders such that when one cylinder extends, the other retracts. The rods of these cylinders are mechanically connected to the boom and control the rotation or swing function of the boom and any bucket attached thereto. With this system, the directional control valve is activated to start and maintain swing motion, and is centered, thus blocking all flow, to stop the swing motion. When this valve is centered, inertia of the moving boom and the bucket mass causes continued motion rather than an instantaneous stop. This continued motion compresses the fluid (especially any entrained air) in the cylinder that the boom and bucket are moving towards, thus resulting in a very high pressure in that cylinder. This high pressure stores energy much like a spring and creates a force that then causes the boom and the bucket to then move in the opposite direction, where the same phenomenon occurs. This oscillating motion eventually decays, but it delays the operator from continuing with digging or other work functions until the boom and the bucket stop. This also inhibits precise position control.

It is therefore a principal object of this invention to provide a swing cylinder oscillation control circuit and valve for oscillating booms which permits smooth deceleration at any stopping point in the swinging of the boom by sensing high pressure in one of the two cylinders that pivot or oscillate the boom.

A further object of this invention is to provide a swing cylinder oscillation control circuit and valve for oscillating booms which will permit an instantaneous stop of the oscillation of the boom by overcoming the inertia of the moving boom.

These and other objects will be apparent to those skilled in the art.

BRIEF SUMMARY OF THE INVENTION

A swing cylinder oscillation control circuit and valve for oscillating booms has a hydraulic circuit of four valves incorporated into a typical boom control system. A shuttle valve is used to connect the higher pressure of one of the cylinders used to oscillate the boom to the inlet of a variable pressure check valve. Two standard check valves then connect the lower pressure of one or the other of the cylinders to the outlet of a variable pressure check valve. The variable pressure check valve is set to be closed at normal operating pressures and will open only when the pressure difference between the cylinders exceeds a set value, e.g., when the boom and the bucket swing momentum creates a high pressure in one cylinder. The variable pressure check valve opens at one pressure differential commonly known as the "crack pressure", and closes at another pressure differential, commonly known as the "re-seat pressure". The crack and re-seat pressures are controlled to be adjustable and to be independent of each other. This valve then functions in the system by opening a flow connection between the two cylinders as soon as any swing "overshoot" causes a high pressure difference. The amount of fluid to be transferred through this connection is controlled by accurately setting both the crack and re-seat pressure of the variable pressure check valve. Transferring the proper amount of fluid from the high pressure cylinder to the low pressure cylinder at the onset of any swing "overshoot," then results in a smooth end-of-motion for the boom and the bucket swing, and provides precise position control.

A variable pressure check valve consists of a poppet with a sealing seat which slides in a bore; a piston which slides in a separate larger bore; a spring between the poppet and piston; a sleeve and retainer assembly containing the valve; and internal passages which interconnect these components. In normal operation, the spring holds the poppet against the seat, blocking flow from the inlet to the outlet. Inlet pressure is communicated through an orifice in the poppet to the top of the piston, and outlet pressure is communicated through a hole in the poppet to the bottom of the piston. The difference between higher inlet and lower outlet pressure creates a force on the piston holding it in the position shown and maintaining the spring force on the poppet. When the inlet-to-outlet pressure difference exceeds a pre-set value control by the poppet seat area and installed spring force, the poppet lifts creating a connection from the inlet to the outlet. This will cause the inlet and outlet pressures to begin to equalize. As this pressure difference decreases, the force on the piston decreases and the spring, normally in compression, will tend to cause the piston to lift. As the piston lifts, the spring compression is reduced therefore lowering the spring force that acts on the poppet. Since the spring force and the poppet seat area control the inlet-to-outlet pressure difference, this reduced force results in a reduced pressure difference or a re-seat pressure, that causes the valve to close. The opening and closing pressure are therefore determined by the poppet seat area; the spring strength and stiffness; and the difference between the poppet and piston strokes which can be controlled accurately and independently of each other.

BRIEF DESCRIPTION OF THE DRAWINGS AND PHOTOS

DESCRIPTION OF THE PREFERRED EMBODIMENTS

Figure 1:
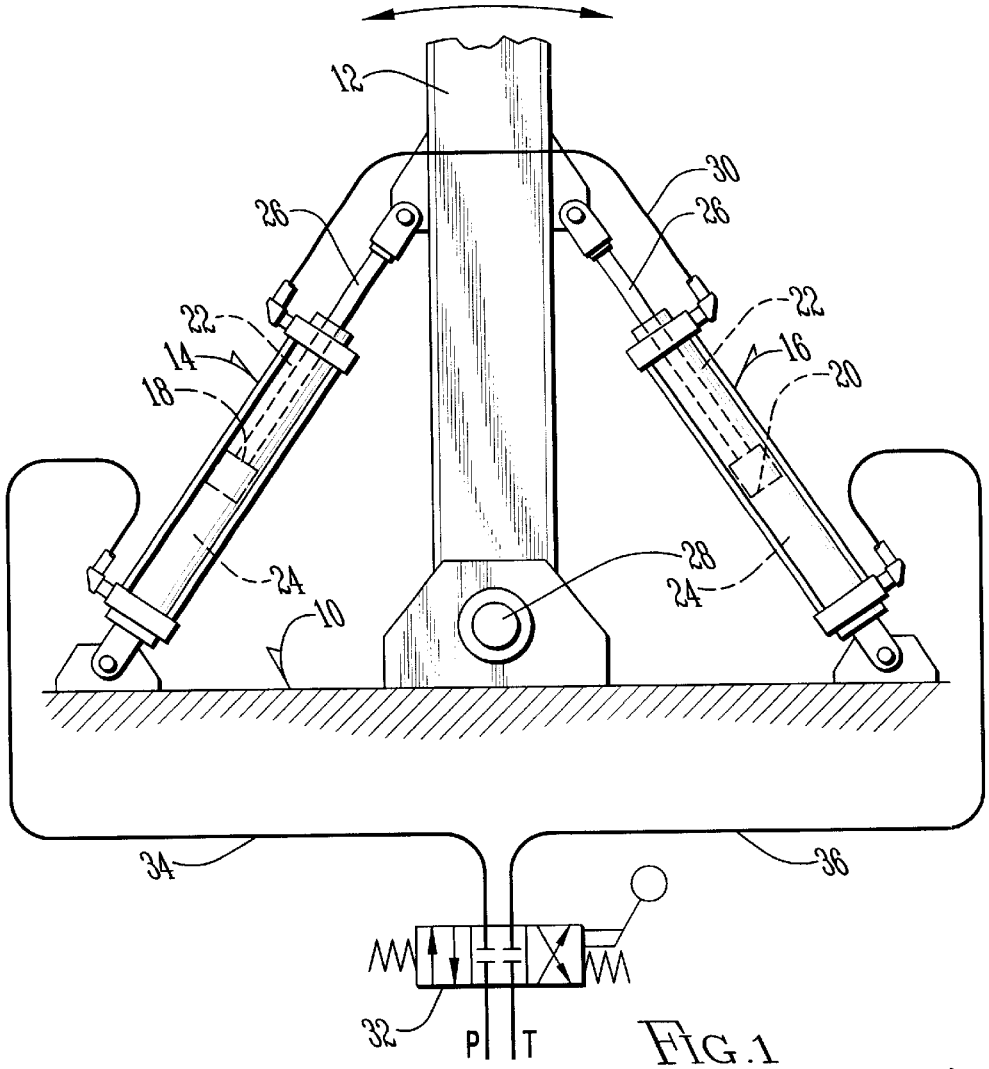
FIG.1 (PRIOR ART)
FIG. 1 is a schematic view of a prior art hydraulic system for a backhoe loader swing function.

The prior art system of FIG. 1 includes a frame 10, a pivotal boom 12, and first and second hydraulic cylinders 14 and 16 which are pivotally secured to the frame and the boom for oscillating the boom. The numeral 18 designates the piston for cylinder 14, and the numeral 20 designates the piston for cylinder 16. Piston rods 26 connect the pistons to the boom. The boom is pivotally connected to the frame 10 by means of the pivotal connection 28.

A first conduit 30 interconnects the cylinders 14 and 16 above the respective pistons thereof. A directional control valve 32 used by the operator to control the movement of boom 12 through the cylinders 14 and 16 is connected to the lower portion of each of the cylinders by conduits 34 and 36, respectively. It is this configuration of FIG. 1 that is unable to smoothly deal with the inertia of the moving boom and bucket mass, and which cannot achieve an instantaneous stop of the boom during its pivotal motion.

Figure 2:
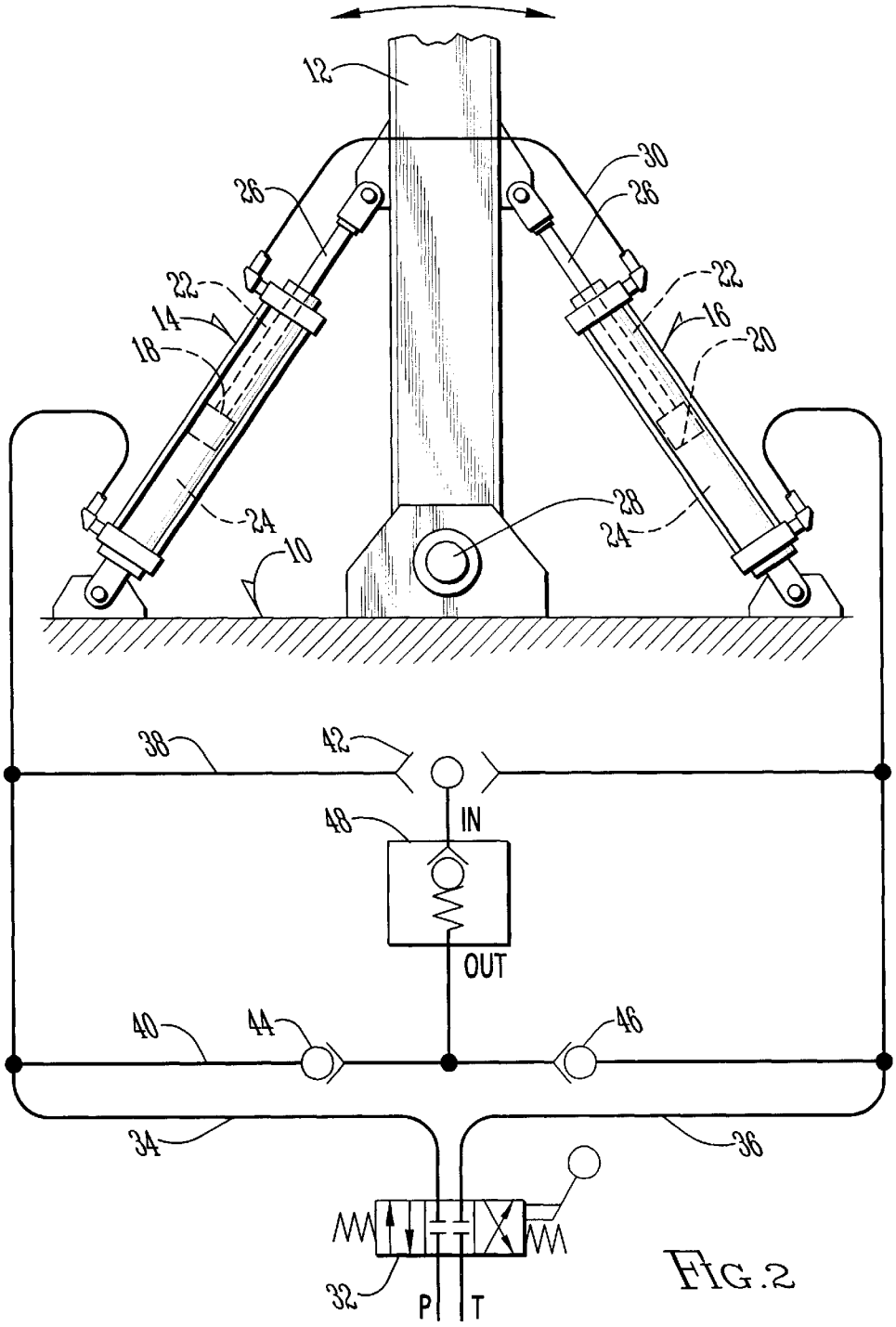
FIG. 2 is a view similar to that of FIG. 1 but shows the shuttle valve, variable pressure check valve, and standard check valves which have been added to the system of FIG. 1.

With reference to FIG. 2, the improvement of this invention over the conventional structure in FIG. 1 is illustrated. Similar numerals have been shown in FIG. 2 which correspond to like components in FIG. 1. Attention is directed to the first and second hydraulic zones 22 and 24 above and below each of the pistons 18 and 20, respectively. Added to the system of FIG. 1, as shown in FIG. 2, is a first hydraulic control line 38 which interconnects conduits 34 and 36. A second hydraulic control line 40 is parallel to line 38 and also interconnects lines 34 and 36. A shuttle valve 42 is imposed in line 38, and conventional directional check valves 44 and 46 are imposed in line 40 in spaced condition. A variable pressure check valve 48 is imposed between the shuttle valve 42 and line 40 at a point in between the check valves 44 and 48.

Figure 3:
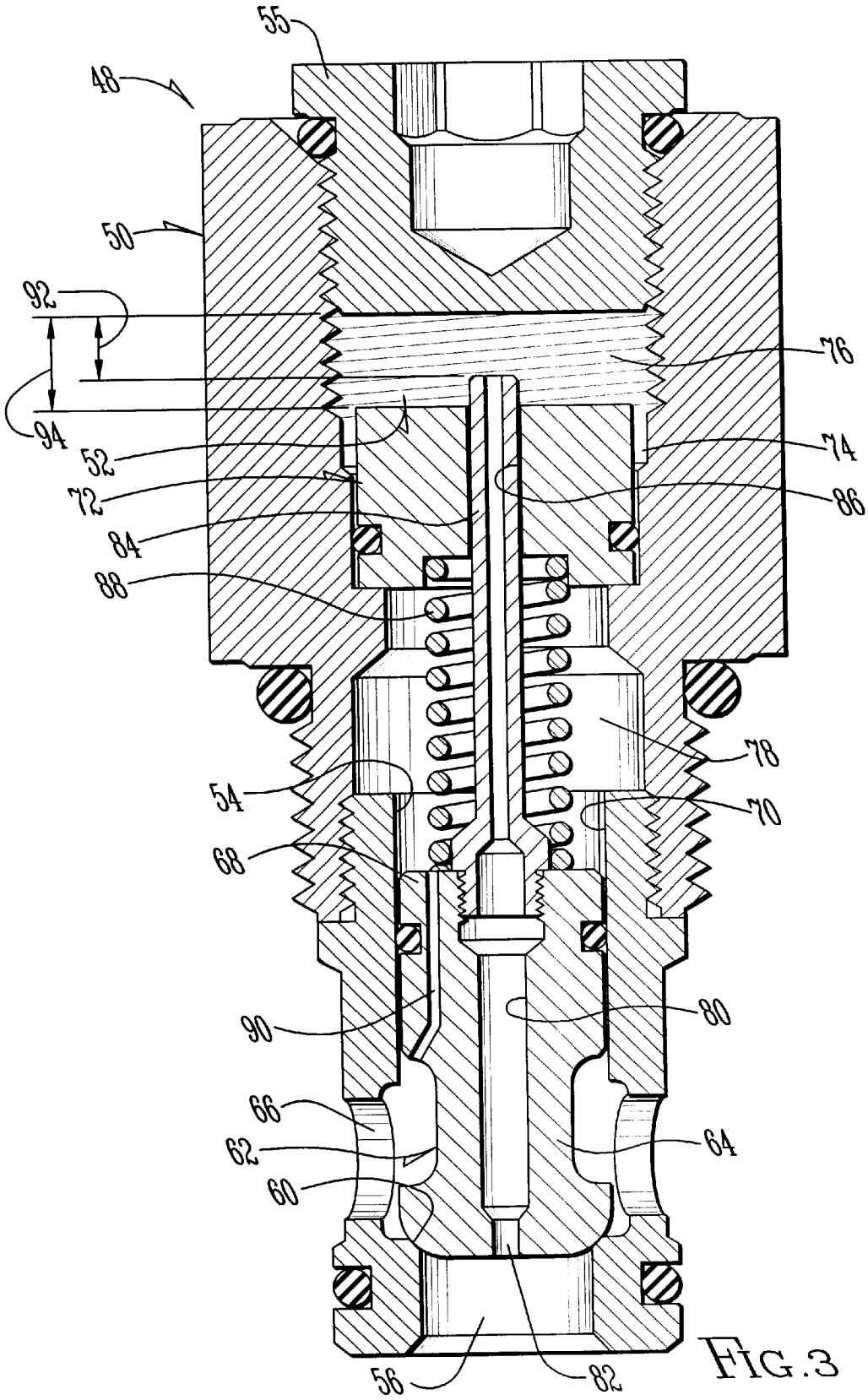
FIG. 3 is a cross-sectional view of the variable pressure check valve of the invention.

With reference to FIG. 3, the details of the variable pressure check valve 48 are disclosed. A valve body 50 has first and second bores 52 and 54 with the bore 52 having a diameter greater than that of the poppet seat 60. End cap 55 closes the "upper" end of bore 52. A fluid inlet port 56 is located at one end of the bore 54 and a valve seat 60 is formed adjacent thereto. A poppet valve body 62 is slidably mounted in the bore 54 and includes a valve element 64 which is adapted to engage valve seat 60 to close inlet port 56 at times. The numeral 66 designates an outlet port in the second bore 54 which is located in spaced condition with respect to the valve seat 60 and the inlet port 56.

Poppet valve body 62 has a head portion 68. Again, the poppet valve body 62 slidably engages the inner wall 70 of bore 54.

A piston 72 is slidably mounted within the first bore 52 which has a center portion 74, a first end space 76, and a second end space 78.

A longitudinal bore 80 is located on the longitudinal center line of poppet valve body 62 and has a small orifice 82 which connects the bore 80 with the inlet port 56. A hollow stem 84 extends from the inner end of poppet valve body 62, and slidably extends through center bore 86 in piston 72, and terminates in the first end space 76 of bore 52. A spring 88 surrounds stem 84 and has its opposite ends engaging piston 72 and poppet valve body 62. A passageway 90 is located in the poppet valve body 62 and connects the outlet port 66 with the end space 78 "below" piston 72. The dimensional arrows 92 and 94 reflect the respective strokes of the poppet valve body 62 and the piston 72.

The design of the pressure check valve 48 can be varied and is determined by the area of valve seat 60, the strength of spring 88 and its spring rate or stiffness, and the difference between the poppet and piston strokes as indicated by the arrows 92 and 94, respectively. It is seen that the poppet and piston strokes can be controlled accurately and independently of each other.

As previously indicated, the variable pressure check valve 48 is set to be closed at normal operating pressures and will open only when the pressure differential between the cylinders 14 and 16 exceeds a predetermined value. The spring 88 is typically set to establish a crack pressure of 3300 psi. When the poppet valve element 64 opens to connect the inlet port 56 with the outlet port 56, the fluid pressures within the cylinders commence to equalize, and the piston 72 moves "upwardly" which lowers the "re-seat" pressure to slowly close the poppet valve element 64 on seat 60. When this takes place, the fluid pressure returns the piston 72 to the position shown in FIG. 3.

This is accomplished, as previously discussed, as the boom is being pivoted (i.e., "normal operation") the spring 88 holds the poppet valve element 64 against the seat 60, blocking flow from the inlet 56 to the outlet 66. Inlet pressure is communicated through the orifice 82 in the lower end of the poppet valve body 62 to the top of the piston 72, and outlet pressure is communicated through the orifice 90 in the poppet valve body 62 to the end space 78 "underneath" piston 72. The difference between the higher inlet pressure at port 56 and the lower outlet pressure at port 66 creates a force on the piston 72 holding it in the position shown in FIG. 3 and maintaining the force of spring 88 on the poppet valve body 62. When the inlet-to-outlet pressure difference exceeds a pre-set value (e.g., 3,300 psi) created by the area of the bottom of the poppet valve body 62 surrounded by seat 60, the fluid pressure at port 56 overcomes the "downward" force of the spring 88, and the poppet valve body lifts creating a fluid connection from the inlet 56 to the outlet 66. This will cause the inlet and outlet pressures to equalize. The shuttle valve 42 will allow the high fluid pressure created in the bottom 24 of either cylinder to trigger the infusion of high fluid pressure to inlet 56 regardless of which cylinder develops this high pressure because of bringing the boom to a stop during its pivotal movement in one direction or another. As seen in FIG. 2, high fluid pressure moving in either direction through line 38 towards shuttle valve 42 will be diverted towards the inlet 56 of the variable pressure check valve 48. When that pressure from one cylinder or another maximizes when the boom stops, and if that pressure at inlet 56 is sufficient to lift the poppet valve body 62 from seat 50, the system begins to do its work by alleviating the slack imposed by the high inertial-induced pressures.

When the inlet and outlet pressures begin to equalize upon being in communication with each other, the force on the "top" of piston 72 decreases. This is because the force on the "top" of piston 72 in space 76 is the high inlet pressure communicated through orifice 82 and hollow stem 84. As the inlet pressure begins to decrease, creating a decrease in pressure differential, when inlet and outlet pressure join upon the opening of poppet valve body 62, the downward force on the piston 72 decreases and the spring will tend to cause the piston 72 to lift. As the compression in spring 88 thereupon decreases, the spring force on the poppet valve body similarly decreases which results in reduced pressure differential (or a re-seat pressure) that causes the poppet valve body 62 to close on seat 60.

As also described above, the crack and re-seat pressures are controlled to be adjustable and to be independent of each other. This valve then functions in the system by opening a flow connection between the two cylinders as soon as any swing "overshoot" causes a high pressure difference. The amount of fluid to be transferred through this connection is controlled by accurately setting both the crack and re-seat pressure of the variable pressure check valve. Transferring the proper amount of fluid from the high pressure cylinder to the low pressure cylinder at the onset of any swing "overshoot" then results in a smooth end-of-motion for the boom and the bucket swing, and provides precise position control.

The passageway 90 in poppet valve body member 62 allows reduced fluid pressure from outlet 66 to be normally "under" the piston 72, but also allows the fluid to vacate space 78 as the re-seat pressure assumes control and the piston 72 moves downwardly as the pressure differential between inlet and outlet pressure decreases.

The variable pressure check valve 48 is mounted within the circuit shown in FIG. 2 with the inlet 56 being adjacent to shuttle valve 42 and the outlet 66 being connected to line 40 between check valves 44 and 48.

It is therefore seen that the check valve 48 will automatically sense the high pressure in one of the cylinders 14 and 16 which will exert "upward" pressure on the poppet valve body 62 to cause it to move upwardly, which will cause the piston 72 to move "upwardly" to overcome the crack pressure of spring 88, whereupon the pressure differential in the cylinders 14 and 16 will start to equalize to create the "re-seat" pressure and which will allow the slow closing of the poppet valve as described heretofore. This phenomenon will provide smooth deceleration at any stopping point in the oscillation path of the boom 12. Transferring the proper amount of fluid from the high pressure cylinder to the low pressure cylinder at the onset of any swing "overshoot" results in a smooth end-of-motion for the boom and provides for precise position control.

It is therefore seen that this invention will achieve at least all of its stated objectives.

I claim:

1. A swing cylinder oscillation control circuit and valve for oscillating booms, comprising, a supporting frame, a boom pivotally secured by one of its ends to the frame for pivotal movement with the frame, a first and second hydraulic cylinder pivotally secured to the frame, a piston slidably mounted in each of the hydraulic cylinders dividing the cylinders into separate first and second hydraulic zones, a piston rod having one end connected to the piston in each hydraulic cylinder, and extending through the first hydraulic zone and outwardly of each cylinder for pivotal connection to the boom, with the pivotal connections to the boom being located on opposite sides of the boom so that cooperative movement of the piston rods can move the boom in pivotal movement in one of two opposite directions with respect to the frame, a first conduit hydraulically connecting the first hydraulic zone of the first and second cylinders, a manually operated directional control valve on the frame, second and third conduits extending from the control valve with the second conduit extending into and communicating with the second hydraulic zone of the first cylinder, and the third conduit extending into the second hydraulic zone of the second cylinder, first and second hydraulic control lines extending between the second and third conduit, a shuttle valve imposed in the first hydraulic control line, spaced opposite directional check valves imposed in the second hydraulic control line, a variable pressure check valve interconnected between the shuttle valve and the second hydraulic control line in between the check valves in the second hydraulic control line, and including means to be independently adjustably opened at a predetermined crack pressure, and to be independently adjustably closed at a predetermined re-seat pressure, with the re-seat pressure being defined as the normal operating hydraulic pressures of the cylinders in the second hydraulic zones thereof, and the crack pressure being defined as the hydraulic pressure differential between the first and second cylinders in the lower hydraulic zones thereof, when the boom reaches a maximum degree of pivotal motion with respect to the frame, as determined by the manually operated directional control valve, creating a predetermined pressure difference between the second hydraulic zones of the first and second cylinders.

2. The apparatus of claim 1 when the pressure check valve comprises, an elongated valve body having a first bore in communication with a second bore with both bores being in longitudinal alignment on a common centerline, a fluid inlet port in an exterior end of the second bore, a valve seat adjacent the fluid inlet port, a poppet valve body slidably mounted in the second bore and having a valve element normally seated on the valve seat to close the port to fluid flow, an outlet port in the elongated valve body located in spaced relation to the inlet port and the valve element to allow fluid to exit the elongated valve body when the fluid inlet port is open, the poppet valve body having a head portion slidably engaging an inner end wall of the second bore opposite the fluid inlet port, a piston slidably mounted within the first bore and being longitudinally slidable therein in a center portion of the first bore between a first end space adjacent an end of the elongated valve body opposite to the fluid inlet port and a second end space adjacent an inner end of the poppet valve body in the first bore, a longitudinal bore in one end of the poppet valve body connecting an orifice open to the fluid inlet port with a hollow stem extending outwardly from the inner end of the poppet valve body, the hollow stem slidably extending through a bore in the piston and communicating with the first end space adjacent the piston, a spring element connecting the piston and the head portion of the poppet valve body normally urging the poppet valve body to close the fluid inlet port, a passageway in the poppet valve body fluidly connecting the outlet port with the second end space adjacent the head portion of the poppet valve body, the fluid inlet port being in connection with the shuttle valve, and the outlet port being in connection with the second hydraulic control line in between the spaced opposite directional check valves.

3. A variable pressure check valve, comprising, an elongated valve body having a first bore in communication with a second bore with both bores being in longitudinal alignment on a common centerline, a fluid inlet port in an exterior end of the second bore, a valve seat adjacent the fluid inlet port, a poppet valve body slidably mounted in the second bore and having a valve element normally seated on the valve seat to close the port to fluid flow, an outlet port in the elongated valve body located in spaced relation to the inlet port and the valve element to allow fluid to exit the elongated valve body when the fluid inlet port is open, the poppet valve body having a head portion slidably engaging an inner end wall of the second bore opposite the fluid inlet port, a piston slidably mounted within the first bore and being longitudinally slidable therein in a center portion of the first bore between a first end space adjacent an end of the elongated valve body opposite to the fluid inlet port and a second end space adjacent an inner end of the poppet valve body in the first bore, a longitudinal bore in one end of the poppet valve body connecting and orifice open to the fluid inlet port with a hollow stem extending outwardly from the inner end of the poppet valve body, the hollow stem slidably extending through a bore in the piston and communicating with the first end space adjacent the piston, a spring element connecting the piston and the head portion of the poppet valve body normally urging the poppet valve body to close the fluid inlet port, and a passageway in the poppet valve body fluidly connecting the outlet port with the second end space adjacent the head portion of the poppet valve body.

* * * * *